US007128053B2

(12) United States Patent
Tokuda et al.

(10) Patent No.: US 7,128,053 B2
(45) Date of Patent: Oct. 31, 2006

(54) CONTROL APPARATUS FOR INTERNAL COMBUSTION ENGINE

(75) Inventors: Takeshi Tokuda, Toyota (JP); Shigeo Okubo, Anjou (JP); Mitsuhiro Nomura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/220,494

(22) Filed: Sep. 8, 2005

(65) Prior Publication Data

US 2006/0054137 A1 Mar. 16, 2006

(30) Foreign Application Priority Data

Sep. 14, 2004 (JP) ..... 2004-267327

(51) Int. Cl.
*F02B 1/00* (2006.01)
*F02B 15/00* (2006.01)

(52) U.S. Cl. ..... 123/429; 123/431; 123/432

(58) Field of Classification Search ..... 123/429, 123/430, 431, 432, 304, 435, 674
See application file for complete search history.

(56) References Cited

U.S. PATENT DOCUMENTS 5,168,839 A * 12/1992 Hitomi et al. ..... 123/184.42
5,870,986 A * 2/1999 Ichinose ..... 123/179.16
5,924,405 A * 7/1999 Hashimoto ..... 123/431
2003/0051692 A1 3/2003 Mizutani
2003/0127072 A1 7/2003 Gmelin et al.
2006/0174856 A1* 8/2006 Watanabe ..... 123/431

FOREIGN PATENT DOCUMENTS

| | | |
|---|---|---|
| DE | 103 50 797 A1 | 5/2005 |
| EP | 1 531 250 A2 | 5/2005 |
| EP | 1 531 252 A2 | 5/2005 |
| EP | 1 531 324 A2 | 5/2005 |
| EP | 1 574 697 A1 | 9/2005 |
| JP | A 2000-265877 | 9/2000 |
| JP | A 2001-073854 | 3/2001 |
| JP | A 2001-336439 | 12/2001 |

* cited by examiner

*Primary Examiner*—John T. Kwon
(74) *Attorney, Agent, or Firm*—Oliff & Berridge, PLC

(57) ABSTRACT

The engine ECU executes the program including the step of starting a timer that counts the time elapsed from a start request, the step of detecting a temperature of the engine, and the step of calculating a DI ratio r such that the fuel is injected from the in-cylinder injector as well, when the engine is in the very cold or cold state, when there is no abnormality in the fuel system, and when starting of the engine is not yet detected even after a lapse of a predetermined period of time from the start request, only if the fuel pressure in the high-pressure system is not lower than a fuel pressure threshold value.

12 Claims, 3 Drawing Sheets

CONTROL APPARATUS FOR INTERNAL COMBUSTION ENGINE

This nonprovisional application is based on Japanese Patent Application No. 2004-267327 filed with the Japan Patent Office on Sep. 14, 2004, the entire contents of which are hereby incorporated by reference.

BACKGROUND OF THE INVENTION

1. Field of the Invention

The present invention relates to a control apparatus for an internal combustion engine having first fuel injection means (an in-cylinder injector) for injecting fuel into a cylinder and second fuel injection means (an intake manifold injector) for injecting fuel into an intake manifold or an intake port, and particularly relates to a technique for starting the internal combustion engine using the fuel injected from the first fuel injection means.

2. Description of the Background Art

An internal combustion engine having a first fuel injection valve (in-cylinder injector) for injecting fuel into a combustion chamber of an engine and a second fuel injection valve (intake manifold injector) for injecting fuel into an intake manifold of the engine, and configured to stop fuel injection from the second fuel injection valve (intake manifold injector) when the engine load is lower than a preset load and to allow fuel injection from the second fuel injection valve (intake manifold injector) when the engine load is higher than the preset load, is known. In this internal combustion engine, the total injection quantity, i.e., a total quantity of the fuel injected from the fuel injection valves, is preset as a function of the engine load. The total injection quantity increases with the increase of the engine load.

The first fuel injection valve (in-cylinder injector) is arranged to open directly to the combustion chamber of the internal combustion engine, and injects the fuel pressurized by a fuel pump directly into the cylinder. The in-cylinder injector injecting the fuel directly into the cylinder of the internal combustion engine is used to improve the fuel efficiency and the like, by accurately controlling the mixed state of the air-fuel mixture within the cylinder by injecting the fuel during the latter stage of the compression stroke.

Since the in-cylinder injector is thus configured to directly inject the fuel into the cylinder, the following inconvenience may arise particularly during the cold start of the internal combustion engine. At the start of the internal combustion engine, it is often the case that the pressure of the fuel in a high-pressure fuel system supplying the fuel into the in-cylinder injector is lower than a prescribed pressure because of insufficient pressurization of the fuel by the high-pressure pump, since the high-pressure pump is driven by the driving force of the internal combustion engine. Thus, at the start of the internal combustion engine, if the fuel is supplied via the intake manifold injector and the in-cylinder injector at a fuel injection ratio therebetween that is set not taking the above-described point into consideration, the in-cylinder injector would inject fuel under the condition where the pressure in the high-pressure fuel system is extremely low immediately after cranking, in which case the fuel injected would be quite inadequate in atomization (or, too large in particulate size).

Such insufficient atomization of the fuel at the start of the internal combustion engine means that, when a prescribed quantity of fuel is supplied, mixing of the fuel with the air would not be conducted efficiently, which may lead to a decrease in concentration of the combustible air-fuel mixture in the vicinity of the spark plug, and thus, lead to failure in startup. If the quantity of the fuel supplied is increased for compensation, the lubricant oil may be diluted with the fuel, or black smoke (particulate matter) may be generated by combustion of the air-fuel mixture that is too rich locally as well as combustion of droplets, leading to deterioration of exhaust gas emission (particularly, HC and CO will increase).

Japanese Patent Laying-Open No. 2001-336439 discloses a fuel injection control apparatus for an in-cylinder fuel injection engine that enables appropriate setting of a ratio between the quantity of the fuel injected into a cylinder and the quantity of the fuel injected into an intake port taking account of the particulate state of the fuel injected into the cylinder at the start of the engine, to thereby improve the engine starting capability as well as the exhaust gas emission. The fuel injection control apparatus for an in-cylinder fuel injection engine disclosed in this publication includes an in-cylinder injector for injecting fuel into a cylinder, and an out-cylinder injector for injecting fuel into an intake pipe, and supplies the fuel at engine start using both injectors. The control apparatus includes fuel injection ratio setting means for setting a fuel injection ratio between the in-cylinder injector and the out-cylinder injector in a variable manner to obtain the total quantity of the fuel required at engine start, using the fuel pressure in the high-pressure fuel system supplying the fuel to the in-cylinder injector as a primary parameter. More preferably, the fuel injection ratio setting means uses the temperature condition upon fuel injection into the cylinder as another parameter, in addition to the fuel pressure in the high-pressure fuel system, and changes the fuel injection ratio such that the quantity of the fuel injected via the out-cylinder injector increases as the fuel pressure in the high-pressure fuel system is lower and the temperature is also lower.

According to this fuel injection control apparatus for an in-cylinder fuel injection engine, the quantity of the fuel injected from the out-cylinder injector is increased as the fuel pressure in the high-pressure fuel system is lower and the temperature is lower as well, to thereby restrict the quantity of the fuel supplied via the in-cylinder injector during the cold start of the engine. This can quickly increase the fuel pressure in the high-pressure fuel system, and accordingly, it is possible to realize atomization of the fuel injected via the in-cylinder injector in a short time.

During the cold start of the engine, it is common practice to decrease the quantity of the fuel injected via the in-cylinder and increase the quantity of the fuel injected via the intake manifold injector, as described in Japanese Patent Laying-Open No. 2001-336439. In doing so, however, the fuel injected via the intake manifold injector in the very cold state would adhere to the wall of the intake pipe or to the intake port of a low temperature, leading to a lean air-fuel ratio of the air-fuel mixture in the combustion chamber. The state where the air-fuel ratio of the air-fuel mixture in the combustion chamber does not become rich continues until adhesion of the fuel on the intake side is saturated, which results in a long time required for starting the engine. Meanwhile, simply causing the in-cylinder injector to inject the fuel as well would not solve the conventional problem as disclosed in Japanese Patent Laying-Open No. 2001-336439.

The condition to increase the quantity of the fuel injected via the out-cylinder injector in the state where the fuel pressure in the high-pressure fuel system is low and the temperature is low, as in the fuel injection control apparatus for an in-cylinder fuel injection engine disclosed in Japanese Patent Laying-Open No. 2001-336439, merely defines that the fuel is injected in a greater quantity from the intake manifold injector. That is, since the condition to increase the quantity of the fuel injected from the in-cylinder injector is not taken into consideration, it is still difficult to make the air-fuel mixture in the combustion chamber rich, resulting in a long starting time.

SUMMARY OF THE INVENTION

In view of the foregoing, an object of the present invention is to provide a control apparatus for an internal combustion engine having a first fuel injection mechanism for injecting fuel into a cylinder and a second fuel injection mechanism for injecting fuel into an intake manifold, that can start the internal combustion engine quickly even in the cold state.

A control apparatus for an internal combustion engine according to the present invention controls an internal combustion engine that has a first fuel injection mechanism for injecting fuel into a cylinder and a second fuel injection mechanism for injecting fuel into an intake manifold. The control apparatus includes: a control unit for controlling the fuel injection mechanisms such that the first fuel injection mechanism and the second fuel injection mechanism inject fuel in a certain fuel injection ratio therebetween based on a condition required for the internal combustion engine; and a starting unit for carrying out a starting process for starting the internal combustion engine in response to a start request, by rotating a rotational shaft of the internal combustion engine by an electric motor. The control unit controls the first fuel injection mechanism to inject the fuel when starting of the internal combustion engine is not detected even after a predetermined period of time has elapsed from initiation of the starting process by the starting unit using the second fuel injection mechanism.

There is a case where starting (or, full combustion) of the internal combustion engine is not detected even after a lapse of a predetermined period of time from initiation of the starting process. At this time, the fuel injected via the second fuel injection mechanism may have adhered to the intake system (inner wall of the intake pipe, or intake port), rather than being introduced into the combustion chamber. In such a case, the air-fuel ratio of the air-fuel mixture in the combustion chamber is not rich, ignitionability is poor, and starting capability is low, so that the engine would not start even after a lapse of the predetermined period of time. Therefore, according to the present invention, the first fuel injection mechanism is used to directly inject the fuel into the combustion chamber, to generate an air-fuel mixture that is rich in air-fuel ratio in the combustion chamber. This improves ignitionability and hence starting capability. In the starting process of the internal combustion engine, the electric motor is used to rotate (crank) the rotational shaft of the internal combustion engine, to thereby actuate the high-pressure pump (plunger pump) in communication with the driving shaft of the internal combustion engine. Therefore, the pressure of the fuel injected via the first fuel injection mechanism increases. That is, as the cranking is started, the high-pressure pump is actuated, and the fuel pressure is increased. Thus, it is considered that atomization of the fuel injected via the first fuel injection mechanism into the combustion chamber is satisfactory. This can solve the problem associated with injection of the fuel via the first fuel injection mechanism during the cold start that is attributable to insufficient atomization. As a result, it is possible to provide a control apparatus for an internal combustion engine in which fuel is injected using both the first fuel injection mechanism injecting fuel into a cylinder and the second fuel injection mechanism injecting fuel into an intake manifold, that can start the internal combustion engine quickly even in the cold state.

Preferably, the control apparatus further includes a detecting unit for detecting a pressure of the fuel supplied to the first fuel injection mechanism. The control unit controls the first fuel injection mechanism not to carry out fuel injection in the starting process if the pressure of the fuel is not more than a predetermined pressure.

In the case where the pressure of the fuel being supplied to the first fuel injection mechanism is lower than a predetermined pressure, there is only a small possibility that sufficient atomization is realized. In such a case, the problem associated with injection of the fuel via the first fuel injection mechanism during the cold start, attributable to insufficient atomization, cannot be solved. Thus, according to the present invention, it is configured not to carry out the fuel injection via the first fuel injection mechanism in such a case.

More preferably, the predetermined period of time is set based on a temperature of the internal combustion engine.

The temperature of the internal combustion engine determines whether the cranking leads to full combustion or not. That is, if the temperature of the internal combustion engine is high, the fuel injected via the second fuel injection mechanism will be introduced into the combustion chamber, rather than adhering to the inner wall of the intake pipe or to the intake port, so that a desired (rich) air-fuel mixture can be formed, ensuring favorable ignitionability. On the other hand, if the temperature of the internal combustion engine is low, the rich air-fuel mixture cannot be formed, leading to poor ignitionability. Thus, according to the present invention, the time is set based on the temperature of the internal combustion engine, and the starting process using only the second fuel injection mechanism proceeds to the starting process using the first fuel injection mechanism as well.

More preferably, a ratio of a quantity of the fuel injected from the first fuel injection mechanism with respect to a total quantity of the fuel injected from the first and second fuel injection mechanisms in the starting process is determined based on a temperature of the internal combustion engine.

If the temperature of the internal combustion engine is high, the fuel injected via the second fuel injection mechanism is introduced into the combustion chamber, instead of adhering to the inner wall of the intake pipe or to the intake port, so that a desired (rich) air-fuel mixture can be formed, which ensures good ignitionability. On the other hand, if the temperature of the internal combustion engine is low, it is not possible to form the rich air-fuel mixture, which leads to poor ignitionability. Thus, according to the present invention, the ratio of the quantity of the fuel to be injected from the first fuel injection mechanism to the total fuel injected quantity at the time when the starting process using only the second fuel injection mechanism proceeds to the starting process using the first fuel injection mechanism as well, is determined based on the temperature of the internal combustion engine. Basically, the fuel injection ratio of the first fuel injection mechanism is set higher as the temperature of the internal combustion chamber is lower such that the air-fuel ratio of the air-fuel mixture in the combustion chamber becomes rich, although the fuel injection ratio is not increased to the range where the problem of black smoke or the like may arise.

More preferably, a ratio of a quantity of the fuel injected from the first fuel injection mechanism with respect to a total quantity of the fuel injected from the first and second fuel injection mechanisms in the starting process is determined based on the predetermined period of time.

The fact that the predetermined period of time for determining transition from the starting process using only the second fuel injection mechanism to the starting process using the first fuel injection mechanism as well is long means that ignitionability is poor. On the other hand, the fact that the predetermined period of time is short means that ignitionability is good. Thus, according to the present invention, the fuel injection ratio of the first fuel injection mechanism when the starting process using only the second fuel injection mechanism proceeds to the starting process using also the first fuel injection mechanism is determined based on the relevant predetermined period of time. Basically, the fuel injection ratio of the first fuel injection mechanism is set higher as the predetermined period of time is longer, so as to obtain a rich air-fuel mixture in the combustion chamber, although the ratio is not increased to the level where the problem such as black smoke may arise.

More preferably, the first fuel injection mechanism is an in-cylinder injector, and the second fuel injection mechanism is an intake manifold injector.

According to the present invention, it is possible to provide a control apparatus for an internal combustion engine where fuel injection is carried out using the in-cylinder injector identified as the first fuel injection mechanism and the intake manifold injector identified as the second fuel injection mechanism at a certain fuel injection ratio therebetween, that can start the internal combustion engine quickly even in the cold state.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
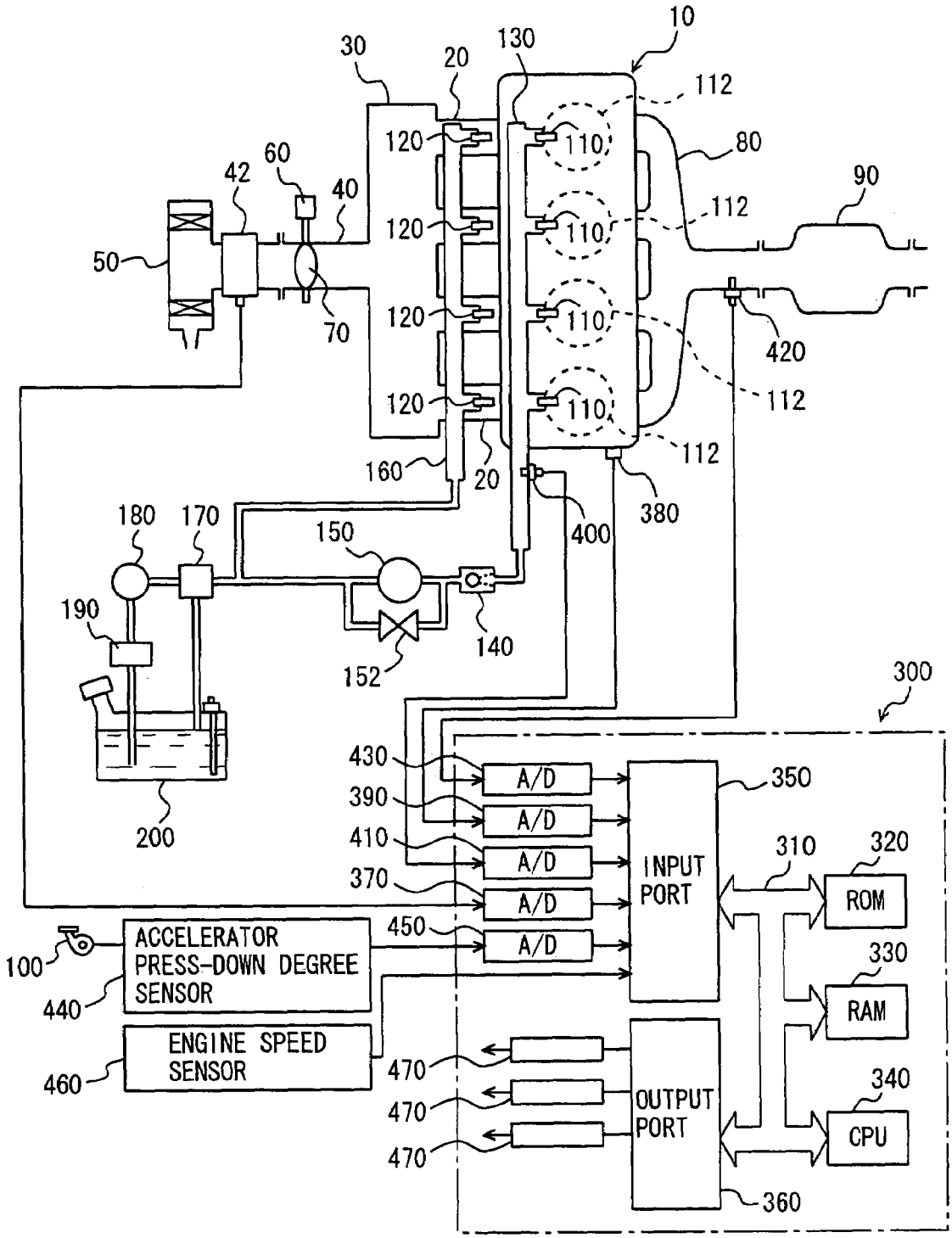
FIG. 1 is a schematic configuration diagram of an engine system controlled by a control apparatus according to an embodiment of the present invention.

Hereinafter, an embodiment of the present invention will be described with reference to the drawings. In the following description, the same portions have the same reference characters allotted, and have the same names and functions. Thus, detailed description thereof will not be repeated.

FIG. 1 schematically shows a configuration of an engine system that is controlled by an engine ECU (Electronic Control Unit) implementing the control apparatus for an internal combustion engine according to an embodiment of the present invention. In FIG. 1, an in-line 4-cylinder gasoline engine is shown, although the application of the present invention is not restricted to such an engine.

As shown in FIG. 1, the engine 10 includes four cylinders 112, each connected via a corresponding intake manifold 20 to a common surge tank 30. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. In the present embodiment, an internal combustion engine having two injectors separately provided is explained, although the application of the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

More specifically, with electromagnetic spill valve 152 provided at the intake side of high-pressure fuel pump 150 in which the fuel is pressurized as a pump plunger moves up and down by means of a cam attached to a camshaft, the timing of closing electromagnetic spill valve 152 during the pressurizing stroke is controlled in a feedback manner by engine ECU 300 using a fuel pressure sensor 400 provided at fuel delivery pipe 130, so as to control the fuel pressure within fuel delivery pipe 130. That is, as electromagnetic spill valve 152 is controlled by engine ECU 300, the quantity and the pressure of the fuel supplied from high-pressure fuel pump 150 to fuel delivery pipe 130 are controlled.

Meanwhile, each intake manifold injector 120 is connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 becomes higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage is input via an A/D converter 370 to input port 350. Airflow meter 42 also has a temperature measuring function. It generates an output voltage proportional to a temperature of the intake air, which is also input via A/D converter 370 to input port 350. It is noted that, instead of providing airflow meter 42 with the temperature measuring function (in many cases, it has the temperature detecting function for temperature calibration of the flow rate), a separate sensor for detecting the intake air temperature may be provided in addition to airflow meter 42. A coolant temperature sensor 380 is attached to engine 10, which generates an output voltage proportional to a coolant temperature of the engine. The output voltage is input via an A/D converter 390 to input port 350.

A fuel pressure sensor 400 is attached to fuel delivery pipe 130, and generates an output voltage proportional to a fuel pressure within fuel delivery pipe 130, which is input via an A/D converter 410 to input port 350. An air-fuel ratio sensor 420 is attached to an exhaust manifold 80 located upstream of three-way catalytic converter 90. Air-fuel ratio sensor 420 generates an output voltage proportional to an oxygen concentration within the exhaust gas, which is input via an A/D converter 430 to input port 350.

Air-fuel ratio sensor 420 of the engine system of the present embodiment is a full-range air-fuel ratio sensor (linear air-fuel ratio sensor) that generates an output voltage proportional to the air-fuel ratio of the air-fuel mixture burned in engine 10. As air-fuel ratio sensor 420, an $O_2$ sensor may be employed, which detects, in an on/off manner, whether the air-fuel ratio of the air-fuel mixture burned in engine 10 is rich or lean with respect to a theoretical air-fuel ratio.

Accelerator pedal 100 is connected with an accelerator press-down degree sensor 440 that generates an output voltage proportional to the degree of press down of accelerator pedal 100, which is input via an A/D converter 450 to input port 350. Further, an engine speed sensor 460 generating an output pulse representing the engine speed is connected to input port 350. ROM 320 of engine ECU 300 prestores, in the form of a map, values of fuel injection quantity that are set in association with operation states based on the engine load factor and the engine speed obtained by the above-described accelerator press-down degree sensor 440 and engine speed sensor 460, and correction values thereof that are set based on the engine coolant temperature.

At the start of engine 10, a starter uses electric power of the battery to rotate a flywheel provided at an end of the crankshaft of engine 10, for a cranking operation. For example, when an ignition key is set to a start position, the cranking operation is conducted, and the fuel injected via intake manifold injector 120 is ignited in the combustion chamber in the cylinder during the compression stroke. When the fuel is properly ignited, the expansion stroke follows, and engine 10 is thus started. The engine speed NE of engine 10 detected by engine speed sensor 460 gradually increases to approach the idling engine speed. Herein, the state where burning is effected normally during the starting process of engine 10 is referred to as a full combustion state. As described above, generally, the fuel is injected via intake manifold injector 120 at the start of engine 10. In contrast, engine ECU 300 implementing the control apparatus of the present embodiment causes in-cylinder injector 110 to inject the fuel as well, when a prescribed condition is satisfied, so as to improve the ignitionability during the cold start to thereby improve the starting capability of engine 10.

Figure 2:
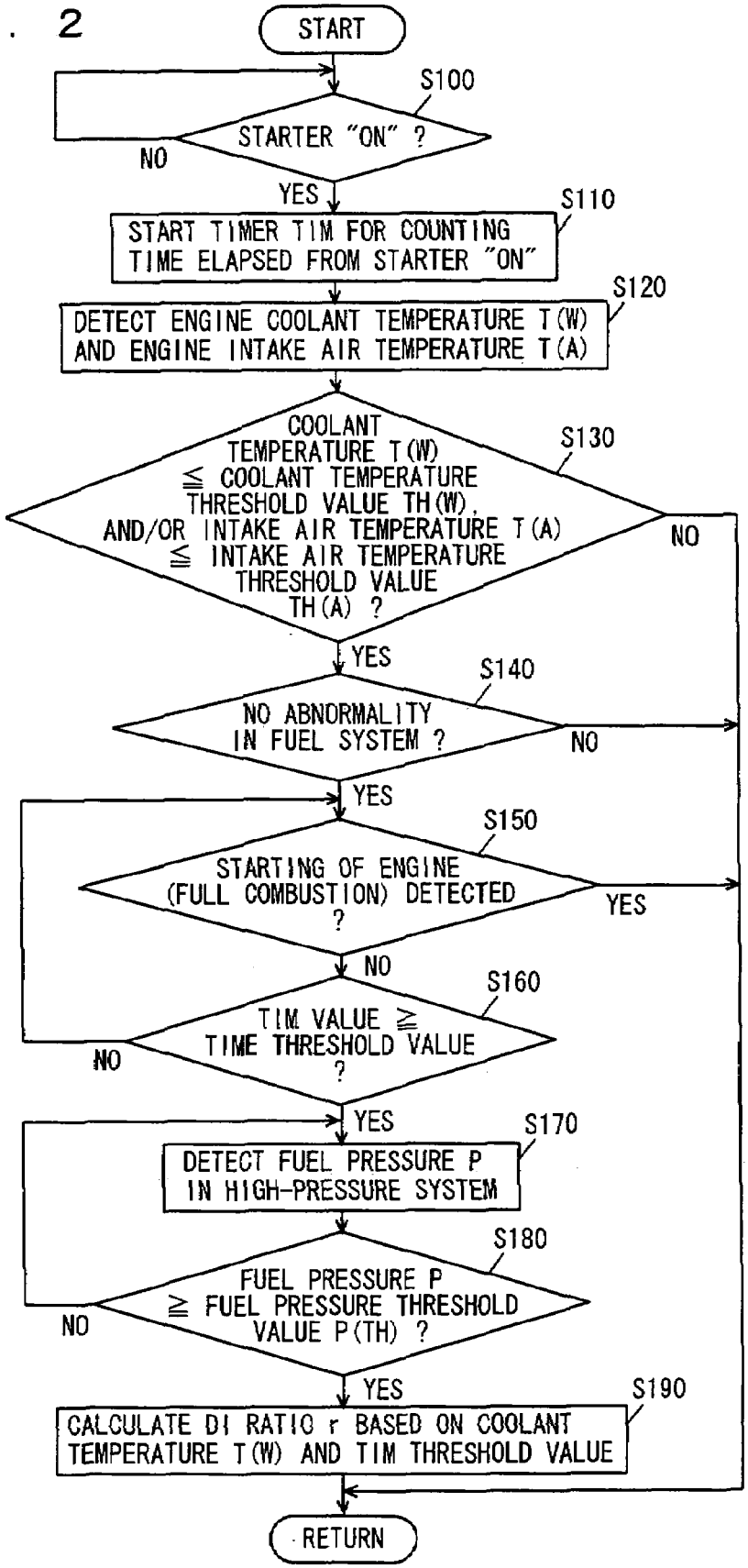
FIG. 2 is a flowchart illustrating a control structure of a program that is executed by an engine ECU implementing the control apparatus according to the embodiment of the present invention.

Hereinafter, a control structure of a program executed by engine ECU 300 implementing the control apparatus for an internal combustion engine according to the present embodiment will be described with reference to FIG. 2.

In step (hereinafter, abbreviated as "S") 100, engine ECU 300 determines whether it is in a starter ON state. Engine ECU 300 makes the determination, e.g., by detecting that the ignition key has been turned to the start position, based on a signal representing the state of the ignition key that is input to engine ECU 300. In the starter ON state (YES in S100), the process goes to S110. If not (NO in S100), the process awaits detection of the starter ON state.

In S110, engine ECU 300 starts a timer TIM for counting the time elapsed from the starter ON. In S120, engine ECU 300 detects an engine coolant temperature T(W) and an engine intake air temperature T(A). The engine coolant temperature T(W) and the engine intake air temperature T(A) are detected based on a signal indicating the coolant temperature that is input from coolant temperature sensor 380 to engine ECU 300 and a signal indicating the intake air temperature input from airflow meter 42 to engine ECU 300, respectively.

In S130, engine ECU 300 determines whether coolant temperature T(W) representing the temperature of the coolant of the engine is equal to or lower than a coolant temperature threshold value TH(W) and/or intake air temperature T(A) representing the temperature of the intake air to engine 10 is equal to or lower than an intake air temperature threshold value TH(A). That is, it determines whether the engine is in the state of low coolant temperature and low intake air temperature. If coolant temperature T(W)≦coolant temperature threshold value TH(W) and/or intake air temperature T(A)≦intake air temperature threshold value TH(A) (YES in S130), the process goes to S140. If not (NO in S130), the process is terminated.

In S140, engine ECU 300 determines whether the fuel system is free of abnormality. Engine ECU 300 makes the determination based on an abnormality diag code (diagnostic code) of the fuel system or the like, which is detected by engine ECU 300 itself. If there is no abnormality in the fuel system (YES in S140), the process goes to S150. If not (NO in S140), the process is terminated.

In S150, engine ECU 300 determines whether starting of engine 10 has been detected. More specifically, engine ECU 300 determines whether engine 10 has entered a full combustion state, based on the change in engine speed of engine 10 detected by engine speed sensor 460, e.g., according to whether the engine speed has exceeded a prescribed value (engine speed for determination of full combustion). Upon detection of starting of engine 10 (YES in S150), the process is terminated. This means that engine 10 has been started even in the state of low coolant temperature and low intake air temperature. If not (NO in S150), the process goes to S160.

In S160, engine ECU 300 determines whether a TIM value, which is a count value of the timer counting the time elapsed from the starter ON, has reached a TIM threshold value (which is set to two or three seconds, for example). If TIM value≧TIM threshold value (YES in S160), the process goes to S170. If not (NO in S160), the process returns to S150, where determination is made as to whether starting of the engine has been detected. That is, if engine 10 is started before the TIM threshold value is reached after the starter ON, the process is terminated. If engine 10 has yet to be started even when the TIM threshold value has been reached after the starter ON, the following process is carried out. It is noted that the TIM threshold value may be set based on the temperature of engine 10, e.g., based on a map of engine coolant temperature T(W) and intake air temperature T(A).

In S170, engine ECU 300 detects a fuel pressure P in the high-pressure system. Specifically, engine ECU 300 detects the fuel pressure based on a signal from fuel pressure sensor 400 provided at fuel delivery pipe 130 on the high-pressure side. In S180, engine ECU 300 determines whether fuel pressure P of the high-pressure system is equal to or greater than a fuel pressure threshold value P(TH). If fuel pressure P of the high-pressure system≧fuel pressure threshold value P(TH) (YES in S180), the process goes to S190. If not (NO in S180), the process returns to S170. While such a process is being carried out, the starter is manipulated for cranking of engine 10, and the high-pressure plunger pump that operates in association with the crankshaft increases the pressure of the fuel in the high-pressure system.

Figure 3:
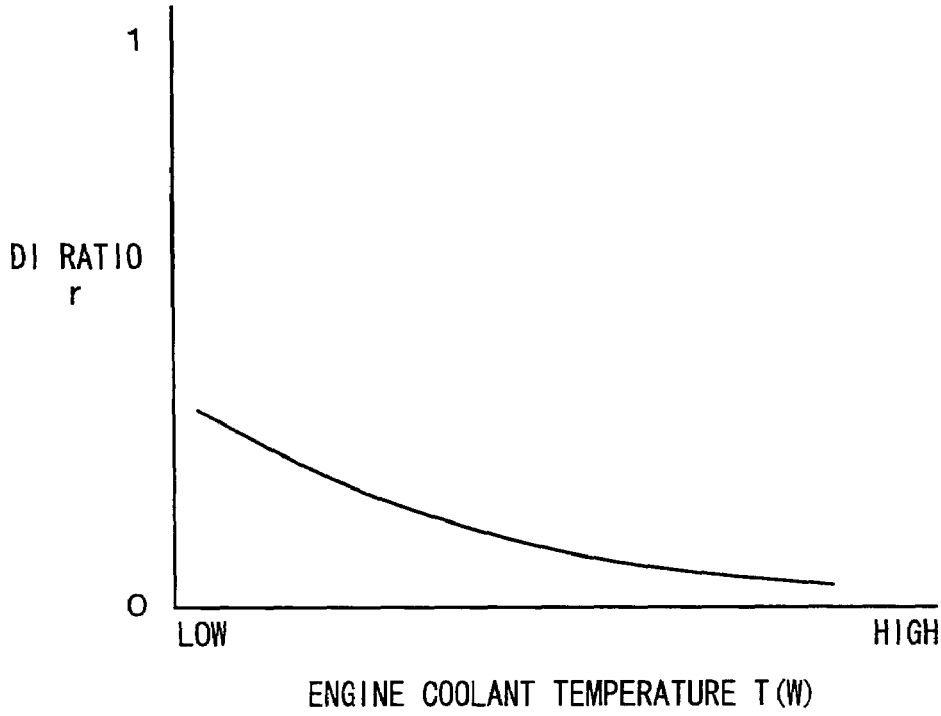
FIGS. 3 and 4 show maps stored in the engine ECU implementing the control apparatus according to the embodiment of the present invention.
Figure 4:
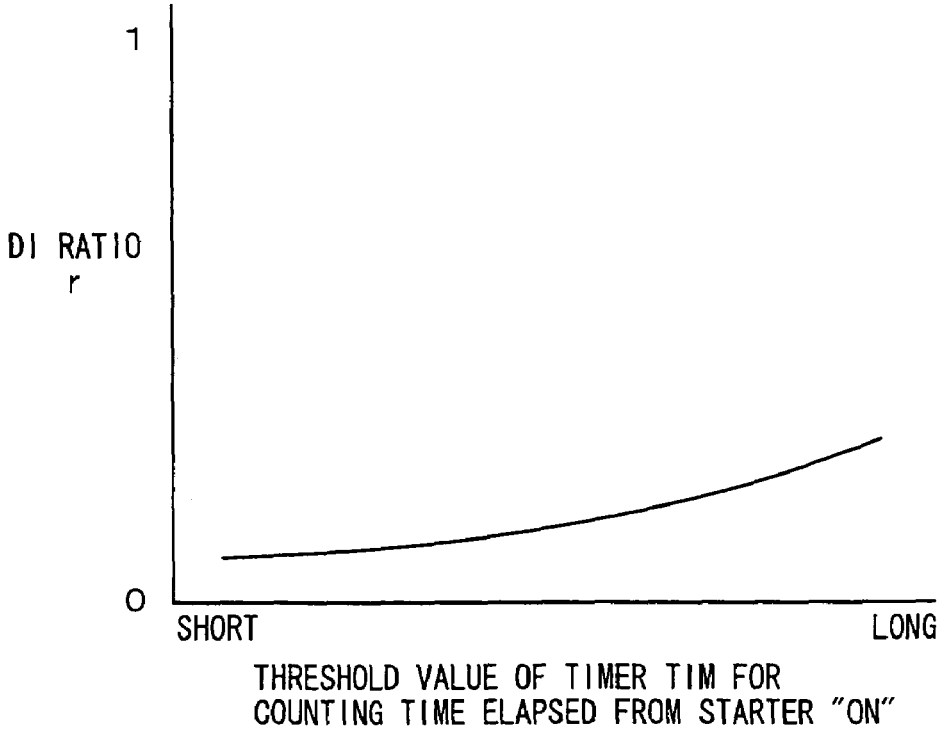

In S190, engine ECU 300 calculates a DI (Direct Injection) ratio r of in-cylinder injector 110 based on the coolant temperature T(W) of engine 10 and the TIM value that is the count value of the timer counting the time elapsed from the starter ON. Here, DI ratio r refers to a ratio of the quantity of the fuel injected from in-cylinder injector 110 with respect to a total quantity of the fuel injected. For calculation of the DI ratio r, maps as shown in FIGS. 3 and 4, for example, are employed. The maps are shown by way of example and are not intended to restrict the present invention.

Hereinafter, an operation of the engine system controlled by engine ECU 300 implementing the control apparatus for an internal combustion engine according to the present embodiment based on the above-described structure and flowchart, will be described.

When a driver turns the ignition key to a start position (YES in S100), the starting process of engine 10 is initiated. At this time, the starter cranks engine 10. The timer for counting the time elapsed from the starter ON starts counting (S110), and the temperatures of engine 10 (engine coolant temperature T(W) and engine intake air temperature T(A)) are detected (S120).

During the very cold state or cold state (YES in S130) and when there is no abnormality in the fuel system (YES in S140), if engine 10 is not yet started (NO in S150) even when the time elapsed from the starter ON has exceeded the TIM threshold value (YES in S160), then fuel pressure P in the high-pressure system is detected (S170). At this time, it is considered that starting of engine 10 is taking long time because the air-fuel mixture in the combustion chamber is lean and thus ignitionability is poor.

If fuel pressure P in the high-pressure system is not less than fuel pressure threshold value P(TH), it is determined that sufficiently atomized fuel will be injected from in-cylinder injector 110 into the combustion chamber. Thus, the fuel is injected from in-cylinder injector 110 as well, at a predetermined DI ratio r. DI ratio r at this time is calculated based on engine coolant temperature T(W) and TIM threshold value TIM(TH) (see FIGS. 3 and 4).

As described above, in the very cold or cold state, there is a case where starting of the engine is not detected even after a predetermined period of time (TIM threshold value) has elapsed since the starting process was initiated using the intake manifold injector. In this case, the fuel injected from the intake manifold injector may have adhered to the inner wall of the intake pipe or to the intake port, rather than being introduced into the combustion chamber. The air-fuel ratio of the air-fuel mixture in the combustion chamber does not become rich, ignitionability is poor, and the engine would not start even after a lapse of the predetermined time from initiation of the starting process. Thus, according to the present invention, the in-cylinder injector is used to directly inject the fuel into the combustion chamber to forcibly generate the air-fuel mixture that is rich in air-fuel ratio in the combustion chamber. This can improve the ignitionability and hence starting capability of the engine. In the engine starting process, a high-pressure plunger pump is activated in response to the rotation of the engine. Thus, the pressure of the fuel injected from the in-cylinder injector is increased, which presumably leads to favorable atomization of the injected fuel. Thus, it is considered that the problem associated with injecting the fuel via the in-cylinder injector in the cold start, which is attributable to insufficient atomization, is unlikely to arise. As a result, in the engine where fuel injection is carried out using both the in-cylinder injector injecting the fuel into the cylinder and the intake manifold injector injecting the fuel into the intake manifold, the internal combustion engine can be started quickly even in the very cold or cold state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having a first fuel injection mechanism for injecting fuel into a cylinder and a second fuel injection mechanism for injecting fuel into an intake manifold, comprising:

a control unit for controlling both of said first and second fuel injection mechanisms based on a condition required for said internal combustion engine; and a starting unit for carrying out a starting process for starting said internal combustion engine in response to a start request, by rotating a rotational shaft of said internal combustion engine by an electric motor; wherein said control unit controls said first fuel injection mechanism to inject the fuel when starting of said internal combustion engine is not detected even after a predetermined period of time has elapsed from initiation of said starting process by said starting unit using said second fuel injection mechanism.

2. The control apparatus for an internal combustion engine according to claim 1, further comprising a detecting unit for detecting a pressure of the fuel supplied to said first fuel injection mechanism, wherein said control unit controls said first fuel injection mechanism not to carry out fuel injection in said starting process if said pressure of the fuel is not more than a predetermined pressure.

3. The control apparatus for an internal combustion engine according to claim 1, wherein said predetermined period of time is set based on a temperature of said internal combustion engine.

4. The control apparatus for an internal combustion engine according to claim 1, wherein a ratio of a quantity of the fuel injected from said first fuel injection mechanism with respect to a total quantity of the fuel injected from said first and second fuel injection mechanisms in said starting process is determined based on a temperature of said internal combustion engine.

5. The control apparatus for an internal combustion engine according to claim 1, wherein a ratio of a quantity of the fuel injected from said first fuel injection mechanism with respect to a total quantity of the fuel injected from said first and second fuel injection mechanisms in said starting process is determined based on said predetermined period of time.

6. The control apparatus for an internal combustion engine according to claim 1, wherein said first fuel injection mechanism is an in-cylinder injector, and said second fuel injection mechanism is an intake manifold injector.

7. A control apparatus for an internal combustion engine having first fuel injection means for injecting fuel into a cylinder and second fuel injection means for injecting fuel into an intake manifold, comprising:

control means for controlling both of said first and second fuel injection means based on a condition required for said internal combustion engine; and starting means for carrying out a starting process for starting said internal combustion engine in response to a start request, by rotating a rotational shaft of said internal combustion engine by an electric motor; wherein said control means includes means for controlling said first fuel injection means to inject the fuel when starting of said internal combustion engine is not detected even after a predetermined period of time has elapsed from initiation of said starting process by said starting means using said second fuel injection means.

8. The control apparatus for an internal combustion engine according to claim 7, further comprising detecting means for detecting a pressure of the fuel supplied to said first fuel injection means, wherein said control means includes means for controlling said first fuel injection means not to carry out fuel injection in said starting process if said pressure of the fuel is not more than a predetermined pressure.

9. The control apparatus for an internal combustion engine according to claim 7, wherein said predetermined period of time is set based on a temperature of said internal combustion engine.

10. The control apparatus for an internal combustion engine according to claim 7, wherein a ratio of a quantity of the fuel injected from said first fuel injection means with respect to a total quantity of the fuel injected from said first and second fuel injection means in said starting process is determined based on a temperature of said internal combustion engine.

11. The control apparatus for an internal combustion engine according to claim 7, wherein a ratio of a quantity of the fuel injected from said first fuel injection means with respect to a total quantity of the fuel injected from said first and second fuel injection means in said starting process is determined based on said predetermined period of time.

12. The control apparatus for an internal combustion engine according to claim 7, wherein said first fuel injection means is an in-cylinder injector, and said second fuel injection means is an intake manifold injector.

* * * * *